United States Patent [19]

Sheppard et al.

[11] 4,412,808

[45] Nov. 1, 1983

[54] DUAL FUELED BURNER GUN

[75] Inventors: Douglas B. Sheppard, Torrance, Calif.; James A. Kezerle, Cary, N.C.; Ellis W. Sheffield, Littleton, Colo.

[73] Assignee: TRW Inc., Redondo Beach, Calif.

[21] Appl. No.: 160,790

[22] Filed: Jun. 19, 1980

[51] Int. Cl.[3] ..... F23C 1/08

[52] U.S. Cl. ..... 431/8; 431/174; 431/177; 431/188; 431/284; 239/397.5; 239/419.3; 239/425

[58] Field of Search ..... 431/8, 174, 177, 278, 431/284, 285, 163, 187, 188; 239/397.5, 398, 400, 419.3, 422, 425, 424

[56] References Cited

U.S. PATENT DOCUMENTS

| | | | |
|---|---|---|---|
| 3,236,279 | 2/1966 | Beyer | 431/284 |
| 3,256,842 | 6/1966 | Vigneron et al. | 431/284 |
| 3,610,536 | 10/1971 | Pease | 239/419.3 |
| 3,777,983 | 12/1973 | Hibbins | 239/422 |
| 3,822,654 | 7/1974 | Ghelfi | 431/284 |
| 4,003,692 | 1/1977 | Moore | 431/284 |
| 4,014,654 | 3/1977 | Howell | 431/187 |
| 4,094,625 | 6/1978 | Wang et al. | 431/284 |
| 4,098,255 | 7/1978 | Nowak et al. | 431/284 |
| 4,162,140 | 7/1979 | Reed | 431/284 |
| 4,285,664 | 8/1981 | Voorheis | 431/284 |
| 4,292,022 | 9/1981 | Hosek | 431/170 |
| 4,303,386 | 12/1981 | Voorheis et al. | 431/284 |

*Primary Examiner*—Samuel Scott
*Assistant Examiner*—Margaret A. Focarino
*Attorney, Agent, or Firm*—Robert W. Keller; Donald R. Nyhagen

[57] ABSTRACT

The present invention resides in a dual fueled burner gun providing reduced production of oxides of nitrogen. The gun operates in a gaseous fueled mode when it is charged with a gaseous fuel or in a liquid fueled mode when it is charged with a liquid fuel. The gun may also operate in a gaseous/liquid fueled mode in which it is charged with both the gaseous and liquid fuels.

13 Claims, 4 Drawing Figures

DUAL FUELED BURNER GUN

BACKGROUND OF THE INVENTION

This invention relates generally to burner guns for burning hydrocarbon fuels in industrial and utility applications, such as in boilers and heating systems. More particularly, the invention relates to burners of this type in which means must be provided for reducing emissions of pollutants such as oxides of nitrogen.

The inherent dangers of air pollution resulting from the combustion of fossil fuels are now widely recognized, and efforts are continually being made to reduce the emissions of harmful pollutants, both from automobile engines and stationary burners used in power generation and in industry. One group of products of combustion that is particularly harmful is that derived from a combination of nitrogen and oxygen. One of these is nitric oxide (NO), a colorless and relatively harmless gas. However, nitric oxide reacts with free oxygen, even at room temperature, to form nitrogen dioxide ($NO_2$), a yellow-brown gas which is toxic to both plant and animal life. Other oxides of nitrogen may also be produced as a result of the combustion of fossil fuels, and oxides of nitrogen are often referred to nonspecifically by the formula NOx.

Related to the problems of air pollution in industrial burners is an additional consideration concerning the conservation and efficient utilization of energy sources. In recent years, it has become increasingly important for industrial burners to be able to operate on a variety of fossil fuels, to accommodate the continual variations in the availability and cost of fuel oil and natural gas, for example. Accordingly, it is now highly desirable to provide a fossil fuel burner for power plants or other industrial uses which can be readily adapted for combustion of either oil or gas. In the past, separate oil and gas burners of various designs have been provided at the same location in the boiler. However, there is now a significant need for a burner gun capable of alternating between gaseous and liquid fossil fuel usage. The present invention is directed simultaneously to this need and to the continuing need to provide low emissions of oxides of nitrogen and increased efficiency.

SUMMARY OF THE INVENTION

Briefly, and in general terms, the present invention resides in a dual fueled burner gun providing reduced production of oxides of nitrogen. The gun operates in a gaseous fueled mode when it is charged with a gaseous fuel or in a liquid fueled mode when it is charged with a liquid fuel. The gun may also operate in a gaseous/liquid fueled mode in which it is charged with both the gaseous and liquid fuels. The fuels that are utilized in the gun are fossil fuels such as gas, oil, refinery waste, coal and coke slurries, synthetic fuels, etc.

Specifically, the gun comprises three concentric tubes arranged to provide inner, outer, and intermediate conduits for supplying the liquid fuel, the gaseous fuel, and an atomizing gas to the nozzle end of the gun. The outer tube supplies the gaseous fuel, the intermediate tube supplies the atomizing gas, and the inner tube supplies the liquid fuel. This arrangement is for convenience only. Other arrangements, of the fluids are possible. The atomizing gas may be steam, fuel gas, nitrogen or other non-reactive gas, fuel such as natural gas or synthetic gas, an oxygen containing gas or mixtures thereof. The preferred gas is steam because steam is readily available for most practical boiler process heat applications. The outer conduit has a plurality of perforations therethrough from which the gaseous fuel is radially ejected. An intermediate conduit has a plurality of perforations laterally spaced from, and aligned with, the perforations of the outer conduit. The atomizing gas is ejected through these perforations in the second conduit. The inner conduit has a distribution manifold which has a plurality of perforations aligned with the perforations in the intermediate conduit through which the liquid fuel is ejected.

The burner gun is mounted within an air register assembly which controls an axially moving combustion air stream past the gun. The combustion air used with the burner tip can be any oxygen containing gas. Typically it is air, but it can be air enriched with oxygen, or air containing an inert dilutent such as recycled flue gas. The fuels are injected into the combustion air stream at an angle substantially perpendicular to the direction of flow of the combustion air stream. In the gaseous fueled mode, simultaneous with the ejection of the gaseous fuel, the atomizing gas may be ejected at an angle substantially perpendicular to the directional flow of the combustion air stream. Steam injection with the gaseous fuel assists in reducing NOx emissions and enhances flame stability. In the liquid fueled mode and gaseous/-liquid fueled mode, the liquid fuel is ejected into the air stream through the atomizing gas for atomization.

The NOx emission is affected by the air to fuel mixing process. Minimum NOx emissions are achieved by establishing burner parameters at optimum levels compatible with safe burner operation. The radial injection of the fuel and steam (or other gaseous medium) contribute significantly to the flame stablization process. Local zones of combustible mixtures are retained in the immediate vicinity of the tip which provide for continuous ignition of the flame.

By controlling fuel atomization, gaseous injection velocities, and combustion air flow characteristics after the air to fuel mixing process, a reduction of maximum local flame temperature levels is accomplished which has a major effect upon the oxidation of combustion air supplied nitrogen to NOx. In the case of liquid fuels, a reduction of fuel supplied nitrogen conversion to NOx is achieved by establishing fuel injection droplet patterns resulting in localized fuel rich combustion. These droplet patterns are inherently available by aerodynamic segregation of the radially injected fuel according to droplet size. The small droplets remain centrally located along the burner axis while the larger droplets travel outward into the bulk of the combustion air. Injected inert gases also tend to reduce flame temperatures through dilution of fuel and oxidizer concentrations.

The important features of the present invention are the lowered production of nitric oxides, flame stability, fuel efficiency, and the ability in one burner to operate in a gaseous fueled mode, a liquid fueled mode, or in both modes simultaneously. To achieve these goals, burner parameters such as, the number, size, and location of the gaseous fuel perforations; the number, size, and location of the liquid fuel/gas perforations in relation to the gaseous fuel perforations; the angle at which the fuels and gas are ejected into the combustion air stream are adjusted to obtain optimum results and will vary depending on burner size, combustion zone configuration, and other factors.

The present invention represents significant advance in the field of fossil fuel burners. In particular it provides a burner gun with substantially reduced emissions of oxides of nitrogen, with the capability of operation with liquid fuels, gaseous fuels, or both, using the same gun structure. Other aspects and advantages of the invention become apparent from the following more detailed description, taken in conjunction with the accompanying drawings.

DETAILED DESCRIPTION

Figure 1:
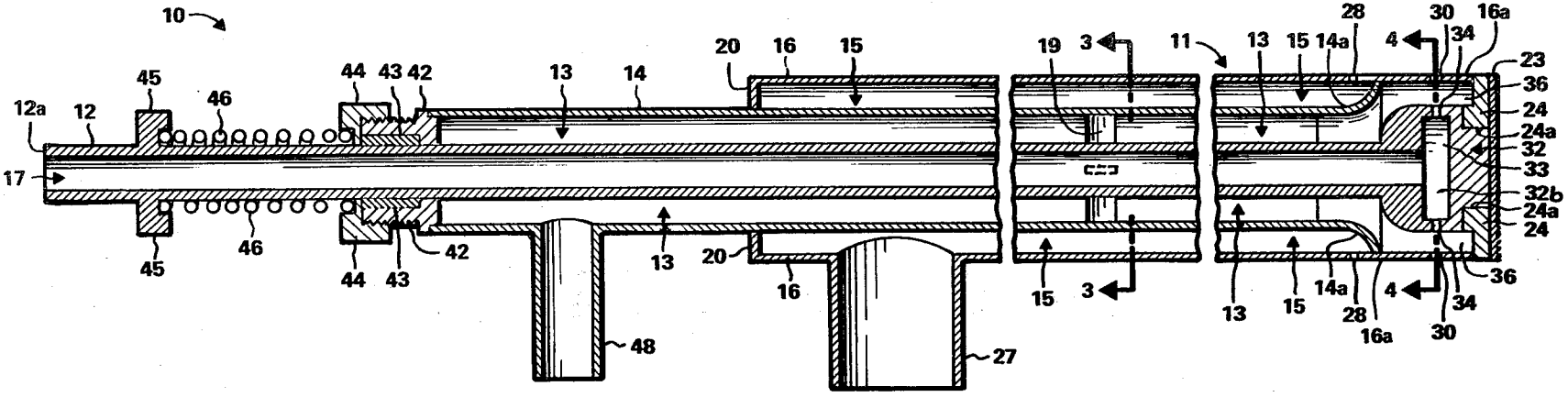
FIG. 1 is a detailed longitudinal sectional view of a dual fueled burner gun in accordance with the present invention.
Figure 3:
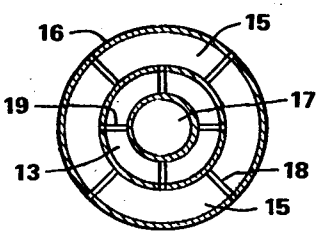
FIG. 3 is a sectional view taken substantially along the lines 3—3 of FIG. 1.

FIG. 1 shows a burner gun 10 having a nozzle end 11. The gun 10 comprises three concentric tubes, 12, 14, and 16, whose walls create inner, intermediate, and outer annular conduits 17, 13, and 15, respectively. A first four-legged spider guide 18, shown in FIG. 3, holds the outer tube 16 concentric with the intermediate tube 14. A second four-legged spider guide 19, also shown in FIG. 3, holds the intermediate tube 14 concentric with the inner tube 12.

One end 20 of the outer tube 16 is sealed shut and welded to the outside of the rear portion of the intermediate tube 14. The other end of the outer tube 16 is sealed shut by a plate 23. Welded to the plate 23 is an annular plug 24 having a central opening 24*a* therein. Connected to the outer tube 16 is a supply nipple 27 which supplies the gaseous fuel to the conduit 15. Around the circumference of the outer tube 16 at the nozzle end 11 are two rows of perforations 28 and 30. The first row of perforations 28 extends through the wall of the outer tube 16 into the outer conduit 15, so that gaseous fuel may be ejected therefrom.

One end 12*a* of the tube 12 extends past the end of the intermediate tube 14 and is connected to a liquid fuel supply (not shown). The other end of the tube 12 has integral therewith a distribution manifold 32 having a male piece 32*a* fitting snugly into the opening 24*a* in plug 24. In the manifold 32 is a cavity 32*b* in communication with conduit 17. A row of perforations 34 along the side of the manifold 32 are aligned with the second row of perforations 30 in the outer tube 16.

Connected to the intermediate tube 14 is a supply nipple 48 which supplies the gas to the intermediate conduit 13. One end of the intermediate tube 14 extends beyond the rear end of the outer tube 16 and has connected thereto a threaded coupling 42 which provides a seal for the intermediate conduit 13. A seal 43 is disposed between the threaded coupling 42 and the exterior of inner tube 12. An annular collar 44 is screwed onto one end of the threaded coupling 42, around inner tube 12. Integral with the outer tube 12 is a flange 45. A preload compression spring 46 is disposed between the flange 45 and the collar 44. Since the fuels and atomizing gas, preferably steam, supplied to the tubes 12, 14, and 16 are at different temperatures, the walls of the tubes expand and contract lengthwise at different rates. The preload compression spring mount maintains the seal of the intermediate tube 14 while allowing for this thermoexpansion and maintains the intermediate tube concentric with the inner and outer tubes.

The intermediate conduit 13 terminates at one end into a distribution manifold 36. The distribution manifold 36 is bounded by the wall 16*a* of the outer tube 16, the flared end 14*a* of the tube 14, plug 24, and the exterior of manifold 32. The row of perforations 30 extends through the wall 16*a* of the outer tube 16 into the distribution manifold 36 for ejection of the steam.

Figure 2:
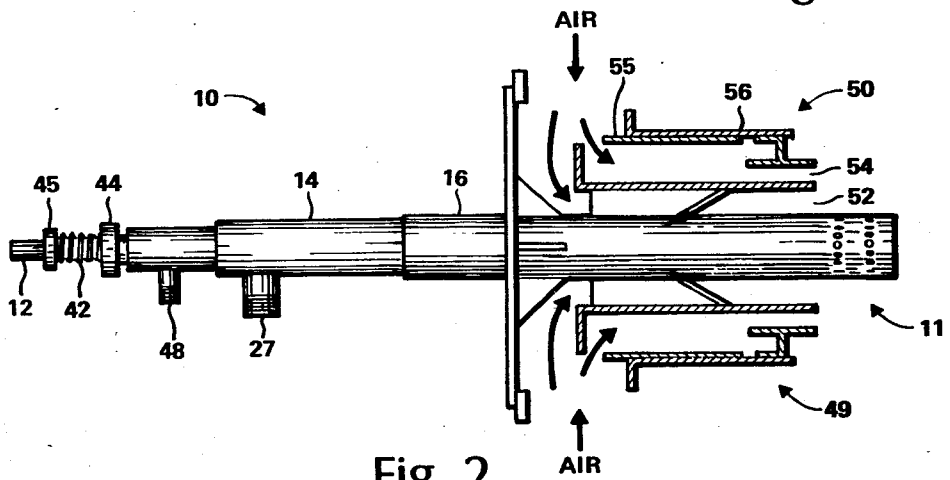
FIG. 2 is simplified elevational view, partly in section, showing a burner and air register assembly constructed in accordance with the present invention.

As indicated in FIG. 2, the burner gun is located generally centrally in an air register assembly 50 having two concentric annular air passageways, an inner passageway 52 and an outer air passageway 54. An air register 56 includes sleeve 55 which is movable axially to control the combustion flow of air to conform to a substantially uniform velocity profile over a substantial portion of the area immediately surrounding the nozzle end. To details of the air register assembly are disclosed in U.S. Patent application, Ser. No. 119,054, entitled Low Polluting Burner Assembly, assigned to the same Assignee as this application, and herein incorporated by reference.

Figure 4:
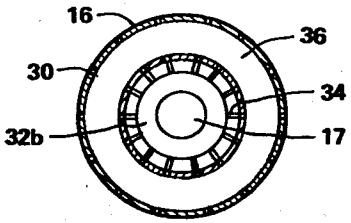
FIG. 4 is a sectional view taken substantially along the line 4—4 of FIG. 1.

In operation the gaseous fuel and liquid fuel are ejected at angles substantially perpendicular to the axially moving combustion air stream. (As used hereinafter, the term "axial" refers to a direction which is substantially parallel with the longitudinal axis of the burner gun 10). In its preferred operation, gaseous fuel and liquid fuel injection are not simultaneous. In the gaseous fueled mode, gaseous fuel is injected through supply nipple 27 into conduit 15 and exits through the perforations 28. In the liquid fueled mode, liquid fuel enters conduit 17 from the liquid fuel supply (not shown) and exits through the cavity 32*b* of the distribution manifold 32 and is partially atomized by the steam in distribution manifold 36 during ejection from the perforations 30. The flow of liquid fuel is indicated by the arrows in FIG. 4 and is ejected as atomized droplets as shown.

Depending on the combustion gas velocity, the fuel injection velocity and momentum, and furnace size, the injection angle of the fuel may be $\pm 30°$ from being exactly perpendicular to the direction of combustion air flow. These parameters affect the flame profile, the flame surface area, and volume, and in turn heat dissipation to the furnace walls. The fuel injection angle normally is exactly perpendicular to the combustion air flow.

The combustion air interacts aerodynamically with the ejected fuel to further atomize it and causes the fuel to burn in an umbrella shaped flame. This umbrella shaped flame is desirable for suppression of NOx formation.

For each installed burner gun, the size, and number of the perforations are important for optimum performance. Temperature of the environment, velocity of the air, fuel temperature and type are all important considerations in the design of the gun. The location of the perforations in the nozzle is also an important consideration for optimum NOx reduction and flame stability.

The momentum of the atomizing gas is also an important variable in design and operation of the burner nozzle. The momentum of the gas is controlled by the size of the perforations in the nozzle and the gas supply pressure. The velocity of the atomizing gas is greater than the velocity of the liquid fuel to achieve atomization of the fuel. If the momentum of the atomizing gas is too high, too much atomization and a higher level of NOx emissions results. On the other hand, low momentum results in inadequate atomization, which can result in an unstable flame and need for excessive quantities of combustion air, which can also result in an increase in NOx emissions.

The flow of steam into the combustion air stream reduces the production of oxides of nitrogen by lowering the peak combustion temperatures in the resulting flame. Three basic mechanisms are believed to underly this phenomenon. First, gaseous combustion products from in front of the flame are drawn toward the burner and recirculated throughout the flame. Secondly, noncombustible water molecules in the form of steam are added to the flame, to further dilute the concentration of burnable molecules per unit volume of the flame. Finally, any water molecules in the liquid state absorb heat during vaporization, to further lower the flame temperature. Reductions of NOx production as great at 60% have been achieved using the gun of the invention instead of a conventional burner gun.

For optimum NOx reduction it has been found that the air flow velocity through passages 52 and 54 is substantially higher (approximately 40%) for the gaseous fuel than for the liquid fuel. However, where low NOx production is not a consideration, increasing the air flow velocity during gaseous fuel ejection is not necessary for operation of the burner.

It will be appreciated from the foregoing that the present invention represents significant advance in the field of industrial type burners of hydrocarbon fuels. In particular, it provides substantially reduced levels of emissions of oxides of nitrogen, and has the capability of burning both liquid and gaseous fuel types without structural modification. Although a particular embodiment of the invention has been described in detail for purposes of illustration, various modifications may be made without departing from the spirit and scope of the invention. Accordingly, the invention is not to be limited except as by the appended claims.

We claim:

1. A dual fueled burner gun, including:

inner, intermediate, and outer tubes arranged concentrically to form an inner annular conduit between said inner and intermediate tubes and an outer annular conduit between said intermediate and outer tubes, and a nozzle at one end of said tubes having first, second, and third ports opening laterally of said tubes, said first ports communicating said inner tube to said inner conduit, said second and third ports communicating said inner and outer conduits, respectively, to the exterior of said gun.

2. The dual fueled burner gun of claim 1, further comprising:

means for supplying a first fuel to said outer conduit to be ejected through said third ports, means for supplying a gas to said intermediate conduit to be ejected from said nozzle through said second ports, and means for supplying a second fuel to said inner tube to be ejected through said first ports into said intermediate conduit such that said second fuel is atomized by said gas prior to ejection.

3. The dual fueled burner gun of claim 2, wherein said first fuel comprises gaseous fuel, said second fuel comprises liquid fuel, and said gas comprises steam.

4. The dual fueled burner gun of claim 2, further including combustion air supply means surrounding the gun for supplying an axially moving combustion air stream into which said first fuel, said gas, and said second fuel are ejected.

5. The dual fueled burner gun of claim 4, wherein said air supply means includes:

means for dividing said air supply into a plurality of concentric annular flow paths about said gun; and air register means for selectively controlling the velocity over a substantial portion of the area immediately surrounding said gun.

6. A dual fueled burner gun as set forth in claim 5, wherein said air register means includes a sleeve movable axially to selectively cover and uncover openings into the flow paths.

7. A burner assembly, comprising:

a means for directing combustion air stream to a combustion chamber;

a burner gas disposed in said air stream, said gun comprising:

first means for ejecting gaseous fuel laterally into the moving combustion air stream thru first ports;

second means for ejecting an atomizing gas laterally into the combustion air stream through second ports spaced along the gun from the first ports; and third means for ejecting liquid fuel through third ports laterally into the atomizing gas flow for ejection into the air stream with said atomizing gas and for atomization of said liquid fuel by said atomizing gas.

8. A burner assembly as set forth in claim 7, wherein said combustion air directing means includes;

means for dividing said air into a plurality of concentric annular flow paths; and register means for selectively controlling the flow of air into each flow path to conform to a substantially uniform velocity profile over a substantial portion of the area immediately surrounding said burner gun.

9. A burner assembly as set forth in claim 8, wherein said register means includes a sleeve movable axially to selectively cover and uncover openings into the flow paths.

10. A burner nozzle for burning a first fuel and a second fuel in a combustion zone, the combustion zone having an air supply for introducing a combustion air stream thereinto, the burner nozzle comprising:

a first plurality of ports for ejecting the first fuel into the combustion air stream;

a second plurality of ports for ejecting the second fuel into the combustion air stream, the first and second pluralities of ports being spaced apart from each other and being oriented for ejecting the fuels into the combustion air stream in directions transverse to the axial flow of the combustion air stream;

first conduit means for conducting said first fuel to said first plurality of ports, second conduit means for conducting said second fuel to said second ports, said second conduit means including a distribution manifold connected to the second plurality of ports, and third conduit means including a second distribution manifold having a third plurality of ports through which the second fuel is ejected to be atomized by the gas.

11. A method for burning a gaseous fuel and a liquid fuel in a combustion zone while suppressing the production of oxides of nitrogen from burning the fuels, the method comprising the steps of:

introducing an oxygen containing combustion air stream into the combustion zone;

ejecting the gaseous fuel into the combustion air stream in a direction transverse to the flow of the combustion air stream; and ejecting the liquid fuel through an atomizing gas into the combustion air stream in a direction transverse to the flow of the combustion air stream and at positions spaced in the flow direction from the gaseous fuel ejection positions, and wherein the atomizing gas is introduced at a sufficient rate and at a sufficient velocity for controlled atomization of the liquid fuel.

12. A burner gun, comprising:

an outer tube for containing a gaseous fuel at a first temperature, said tube having means for ejecting said gaseous fuel transversely into a combustion air stream flowing along the gun;

an intermediate tube for containing an atomizing gas at a second temperature, said intermediate tube having means for ejecting said atomizing gas transversely into the combustion air stream, an inner tube for containing liquid fuel at a third temperature, said inner tube having means for ejecting said liquid fuel transversely into the combustion air stream, said liquid fuel contacting said atomizing gas prior to being ejected into the air stream, whereby said gas atomizes said liquid fuel; and means for compensating for the thermal expansion and contraction of said tubes caused by the difference in the temperatures of the atomizing gas and said fuels in said tubes.

13. The gun of claim 12, wherein said atomizing gas is steam.

* * * * *